US006521294B2

(12) United States Patent
Rigney et al.

(10) Patent No.: US 6,521,294 B2
(45) **Date of Patent: *Feb. 18, 2003**

(54) ALUMINIDING OF A METALLIC SURFACE USING AN ALUMINUM-MODIFIED MASKANT, AND ALUMINUM-MODIFIED MASKANT

(75) Inventors: Joseph D. Rigney, Milford, OH (US); Jeffrey A. Pfaendtner, Blue Ash, OH (US); Michael J. Weimer, Loveland, OH (US); Ramgopal Darolia, West Chester, OH (US)

(73) Assignee: General Electric Co., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/373,267

(22) Filed: Aug. 11, 1999

(65) Prior Publication Data

US 2001/0053413 A1 Dec. 20, 2001

(51) Int. Cl.[7] ..... B05D 1/32

(52) U.S. Cl. ..... 427/253; 427/255.19; 427/255.21; 427/259; 427/261; 427/282

(58) Field of Search ..... 427/259, 282, 427/261, 252, 255.19, 255.21, 253

(56) References Cited

U.S. PATENT DOCUMENTS

| | | | | | |
|---|---|---|---|---|---|
| 3,801,357 A | * | 4/1974 | Baldi | 117/107.2 P |
| 3,904,789 A | * | 9/1975 | Speirs et al. | 427/282 |
| 4,141,760 A | | 2/1979 | Baldi | 148/31.5 |
| 4,181,758 A | * | 1/1980 | Elam | 427/259 |
| 4,350,719 A | | 9/1982 | Baldi | 427/253 |
| 4,537,927 A | | 8/1985 | Baldi | 524/407 |
| 4,617,202 A | | 10/1986 | Baldi | 427/253 |
| 4,937,274 A | * | 6/1990 | Arima et al. | 523/220 |
| 4,978,558 A | * | 12/1990 | Lamm | 427/282 |
| 5,262,466 A | * | 11/1993 | Baldi | 524/430 |
| 5,350,558 A | * | 9/1994 | Kawato et al. | 419/35 |
| 5,712,050 A | * | 1/1998 | Goldman et al. | 428/680 |
| 5,725,905 A | | 3/1998 | Walter et al. | 427/156 |

FOREIGN PATENT DOCUMENTS

GB 2210387 A 6/1989

OTHER PUBLICATIONS

Shackford, James F., *Introduction to Materials Science for Engineers*, 3rd ed., 1992, pp. 327–328.*

* cited by examiner

*Primary Examiner*—Shrive Beck
*Assistant Examiner*—Kirsten A. Crockford

(57) ABSTRACT

A metallic substrate has a substrate surface having a substrate surface of nickel, a substrate aluminum content, and other alloying elements. A maskant is applied overlying the substrate surface to produce a masked substrate surface having an exposed region and a protected region. The maskant includes a plurality of maskant particles, each particle having a maskant particle composition comprising a maskant metal selected from the group of nickel, cobalt, titanium, chromium, iron, and combinations thereof, and a maskant aluminum content. The substrate is aluminided by contacting a source of aluminum to the masked substrate surface, whereby aluminum deposits on the exposed region and does not deposit on the protected region.

14 Claims, 3 Drawing Sheets

ALUMINIDING OF A METALLIC SURFACE USING AN ALUMINUM-MODIFIED MASKANT, AND ALUMINUM-MODIFIED MASKANT

FIELD OF THE INVENTION

This invention relates to applying an aluminum-containing coating to a metallic surface, and, more particularly, to a maskant that allows some regions of the surface to be coated and prevents the coating of other regions.

BACKGROUND OF THE INVENTION

Nickel-base superalloy components of gas turbines are sometimes coated with aluminum and simultaneously heated to diffuse the aluminum into the surface of the article. The aluminum-rich surface is thereafter oxidized by heat treatment or in service to produce an adherent aluminum oxide scale on the surface of the article. The aluminum oxide scale is effective in inhibiting and slowing further oxidation and corrosion of the component in service. The aluminum may also be interdiffused with preexisting layers of other compositions to produce more complex diffusion aluminide protective coatings.

The aluminum-containing coating is typically applied by vapor phase deposition, chemical vapor deposition, pack cementation, above-the-pack processing, or similar techniques. In one such approach, aluminum halide gas is contacted to the component surface under conditions such that the compound decomposes to leave a layer containing aluminum deposited on the surface. The aluminum-containing coating diffuses into the surface during the deposition and any post-deposition heat treatment, producing the aluminum-enriched surface region.

It is sometimes the case in such deposition processes that a first region of the surface of the article is to be left uncoated, and a second region of the surface of the article is to be coated with the aluminum-containing material. In order to prevent deposition of aluminum from the aluminum-containing source, the first (uncoated) region of the surface of the article is physically covered with a maskant that overlies and contacts the surface of the article. The maskant prevents contact of the aluminum-containing gas to the first region of the surface. Available maskants usually include sources of $Ni^{+2}$ and $C^{+r}$ ions in a binder complex with $Al_2O_3$ and possibly other oxide particles. These maskants are intended to prevent the coating vapors from reaching the surface of the article.

The present inventors have observed that, after removal of the maskant from the first region of the substrate surface, there may be a depletion of the aluminum content of the substrate alloy at the substrate surface to a depth of up to about 0.0005–0.002 inches. In addition to providing strengthening of the substrate through the formation of gamma prime precipitates, the aluminum forms a protective aluminum oxide that inhibits destructive oxidation of the substrate during service at elevated temperatures. The depletion in aluminum content under the maskant, even to a relatively small depth, results in a loss of oxidation resistance at the uncoated surface, and may also result in a reduction in the mechanical properties of the material due to the reduced ability to form gamma prime precipitates. The depletion in aluminum content may also adversely affect other processing modifications of the substrate surface.

There is a need for an improved approach to the aluminide coating of an article surface where some of the surface must remain uncoated.

BRIEF SUMMARY OF THE INVENTION

The present invention provides an improved maskant for use in aluminiding a surface, and a method of aluminiding that utilizes the maskant. The maskant functions to prevent aluminiding of the region of the surface covered by the maskant, while at the same time substantially reducing and, ideally, eliminating depletion of aluminum from the region of the substrate surface covered by the maskant. The maskant is used in the same manner as conventional maskants.

A maskant is used in aluminiding a surface of a metallic substrate, where the metallic substrate has a substrate surface composition comprising nickel, a substrate aluminum content, and other alloying elements. The maskant includes a plurality of maskant particles, each particle having a maskant particle composition comprising a maskant metal selected from the group consisting of nickel, cobalt, titanium, chromium, iron, and combinations thereof, and a maskant aluminum content. The maskant metal is preferably nickel.

A method for aluminiding a portion of a surface, while not aluminiding other portions of the same surface, comprises the steps of providing a metallic substrate having a substrate surface and a substrate surface composition comprising nickel, a substrate aluminum content, and other alloying elements, and applying a maskant overlying a protected region of the substrate surface to produce a masked substrate surface having an exposed region and the protected region. The maskant comprises a plurality of maskant particles, each particle having a maskant particle composition comprising a maskant metal selected from the group consisting of nickel, cobalt, titanium, chromium, iron, and combinations thereof, and a maskant aluminum content. The method further includes contacting an aluminum-containing material to the masked substrate surface, whereby aluminum deposits on the exposed region and does not deposit on the protected region.

The maskant particles of the maskant may be of substantially the same composition as the substrate surface. The maskant particles may instead be primarily the maskant metal and aluminum, with the aluminum content preferably about that of the substrate, but without other expensive alloying elements found in the substrate that have no function in the maskant. In another alternative, the aluminum content of the maskant particles is as high as the final aluminum content of the coating to be applied in the unmasked areas. Intermediate aluminum contents are also operable.

The maskant particles may be the only type of metallic particles present, or there may be conventional particles such as nickel particles having substantially no aluminum.

The maskant particles may be distributed throughout the maskant, or they may be preferentially concentrated at the surface of the maskant that lies adjacent to the substrate surface. In the latter case, the maskant particles may be applied directly to the surface of the substrate or may be preferentially positioned at the surface of an applied maskant layer.

The maskant particles reduce the reactivity of the maskant for the aluminum in the substrate, to inhibit depletion of the aluminum from the protected portion of the substrate contacted by the maskant, while retaining the ability of the maskant to react with aluminum externally introduced in the aluminiding process This latter ability is important to prevent the aluminum introduced by the aluminiding process from reaching and reacting with the protected portion of the substrate surface.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
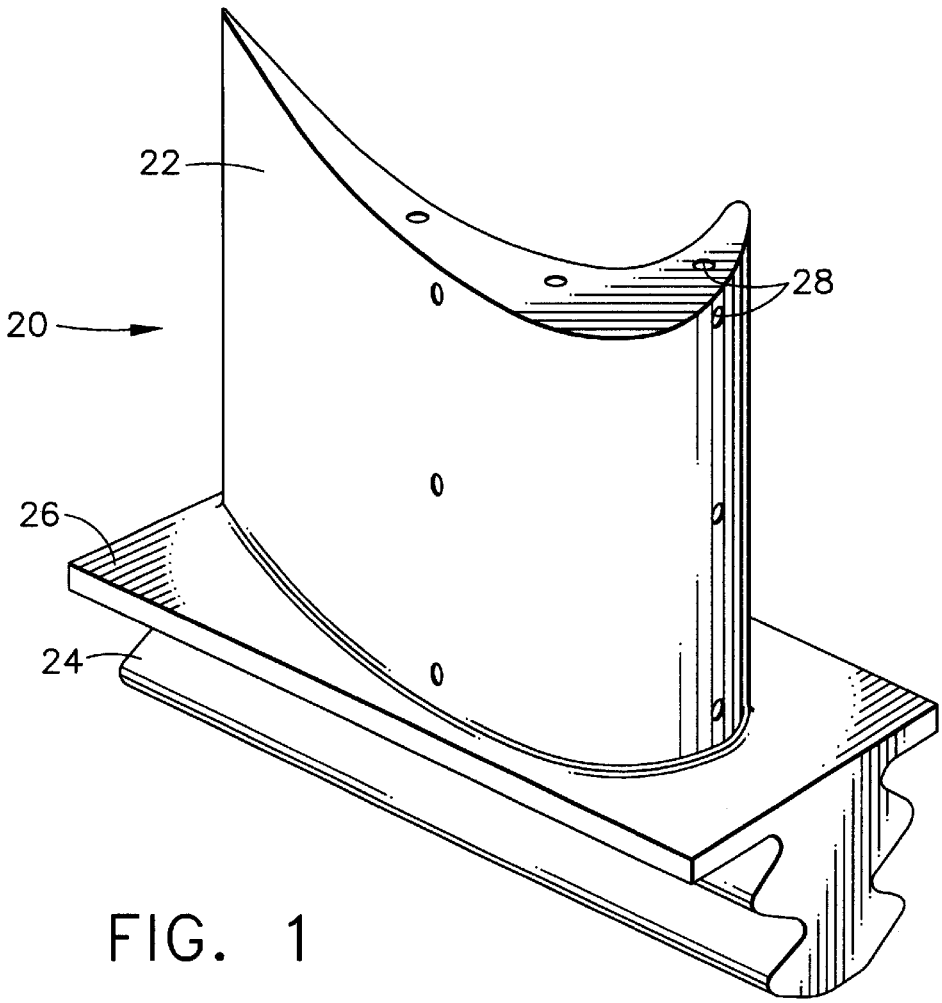
FIG. 1 is a perspective view of a turbine blade.

FIG. 1 depicts a component article of a gas turbine engine such as a turbine blade or turbine vane, and in this illustration a turbine blade 20. The turbine blade 20 includes an airfoil 22 against which the flow of hot exhaust gas is directed. (The turbine vane has a similar appearance in respect to the pertinent portions.) The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. In some articles, a number of cooling channels extend through the interior of the airfoil 22, ending in openings 28 in the surface of the airfoil 22. A flow of cooling air is directed through the cooling channels, to reduce the temperature of the airfoil 22.

For some applications, it is necessary to apply a coating of another metal, such as one containing aluminum, to some regions of the turbine blade 20, while preserving other regions as uncoated. For example, it may be necessary to coat the airfoil 22 and leave the dovetail 24 uncoated. Or it may be necessary to coat some regions of the airfoil and leave other regions of the airfoil uncoated. Or it may be necessary to coat the interior surfaces of the cooling channels but not the exterior surfaces of the airfoils. The present invention relates to such coating procedures.

Figure 2:
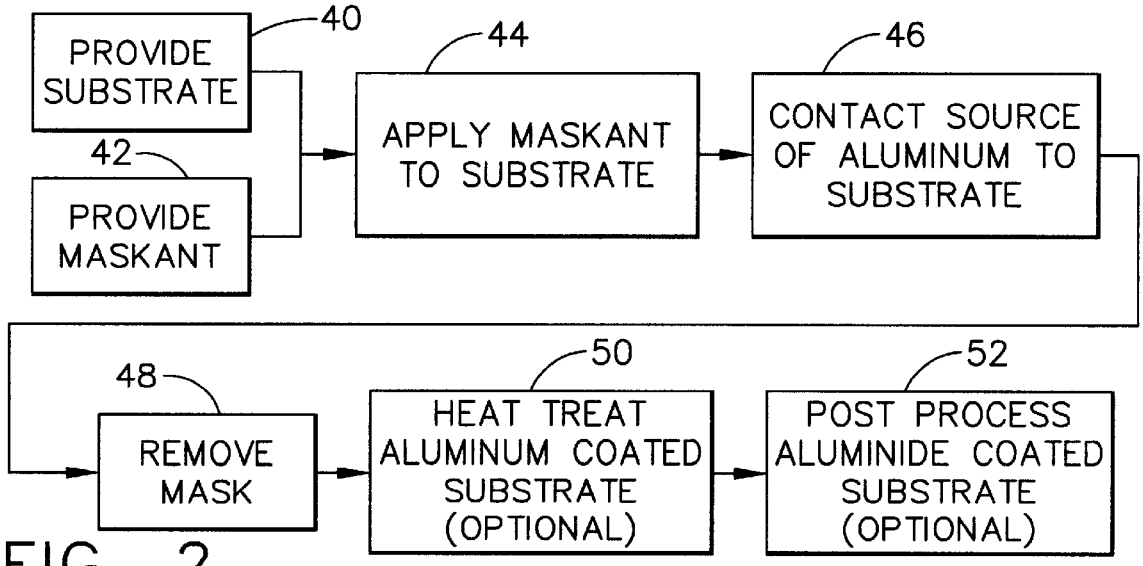
FIG. 2 is a block flow diagram of a method for aluminiding a surface.
Figure 3:
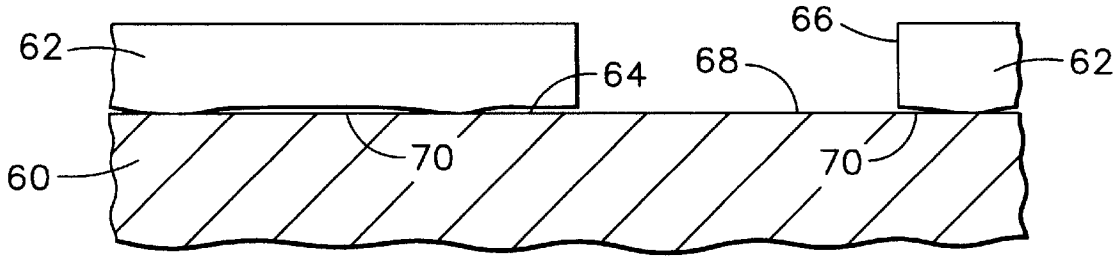
FIG. 3 is a schematic sectional view of a masked substrate article according to a first embodiment of the invention.

FIG. 2 depicts a preferred approach for practicing the coating for the case of the preferred case of coating with aluminum ("aluminiding"), and FIG. 3 illustrates the associated structure. A substrate 60 is provided, numeral 40. The substrate 60 is illustrated as the turbine blade 20 of FIG. 1 in the preferred embodiment, but the invention is operable with other types of substrates as well. The substrate 60 is preferably made of a nickel-base superalloy. As used herein, "nickel-base" means that the composition has more nickel present than any other element. The nickel-base superalloys are typically of a composition that is strengthened by the precipitation of gamma-prime phase. The nickel-base superalloy typically includes nickel and aluminum, the aluminum serving both to form an aluminum oxide on the surface of the substrate and to form gamma prime precipitates in the matrix to strengthen the substrate. The preferred nickelbase alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 1.5 percent hafnium, balance nickel and incidental impurities.

A most preferred alloy composition is Rene' N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities. Other operable superalloys include, for example, Rene' N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities; Rene' 142, which has a nominal composition in weight percent of about 6.8 percent chromium, 12.0 percent cobalt, 1.5 percent molybdenum, 2.8 percent rhenium, 1.5 percent hafnium, 6.15 percent aluminum, 4.9 percent tungsten, 6.35 percent tantalum, 150 parts per million boron. 0.12 percent carbon, balance nickel and incidental impurities; CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. No. 5,482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability.

A maskant 62 is provided, numeral 42. The maskant 62 typically is layer-like in form to cover a surface 64 of the substrate 60. The maskant 62 has openings 66 therethrough. The maskant 62 and its openings 66 together define exposed regions 68 and protected regions 70 of the surface 64 of the substrate 60. The exposed regions 68 ultimately have aluminum deposited on them in the subsequent steps of the processing, and the protected regions 70 have substantially no aluminum deposited on them following the same steps.

The maskant 62 may be any operable aluminum-modified masking material. It may be in any operable physical form, such as a tape, a slurry, a powder, or a putty. In one form, the maskant 62 is a single layer of tape, slurry, powder, or putty, typically containing metallic powders in a binder. In another form, the maskant 62 has two layers, of different compositions but both layers containing metallic powders in a binder. Some specific preferred maskant structures are discussed in relation to FIGS. 4–7. In each case the maskant may be specially formulated, or it may be based on commercially available maskants that have been modified as disclosed herein. For example, T-block masking tape maskant is available commercially from Chromalloy Israel, Ltd. This masking tape comprises a first mask sublayer overlying and contacting the surface 64, and a second mask sublayer overlying and contacting the first mask sublayer. The first mask sublayer is formed of a mixture of nickel and chromium powders in a binder. The second mask sublayer is formed of a mixture of aluminum oxide powder, other ceramic powders such as aluminum silicate, and metallic powders, such as nickel powder, in a binder. The maskant 62 may be of any operable thickness, and typically is from about 0.028 inch to about 0.090 inch thick.

The maskant 62 of the present approach includes maskant particles 72 comprising nickel and a maskant aluminum content. The maskant particles comprise a maskant metal selected from the group consisting of nickel, cobalt, titanium, chromium, iron, and combinations thereof, and also a maskant aluminum content. Nickel is the preferred maskant metal. The maskant particles 72 include primarily the maskant metal, but with aluminum added. The aluminum content must be more than zero, preferably is more than about 0.3 percent by weight, and is most preferably more than about 5 percent by weight of the maskant particles 72. The aluminum content of the maskant particles 72 may be substantially the same (i.e., to within about +/−1 percent) as the substrate aluminum content, which is typically in the range of from about 5 to about 7 weight percent of the substrate, so that there is substantially no tendency to either add or remove aluminum at the protected region 70 of the surface 64 of the substrate 60. The aluminum content of the maskant particles 72 may be greater than the substrate aluminum content. In some cases, the aluminum content of the maskant particles 72 may be as high as the aluminum content of an aluminum additive layer, created in the exposed regions 68 after the subsequent processing steps, and typically from about 20 to about 30 weight percent. Intermediate compositions are also operable. Thus, the maskant particles typically have aluminum contents of from about 0.3 to about 30 weight percent, most preferably in the range of from about 5 to about 7 weight percent.

The maskant particles 72 may be of the same composition as the substrate 60. However, in most cases this is not preferred, because the substrate usually contains expensive alloying elements not required in the maskant particles 72. Instead, as noted, the aluminum content of the maskant particles may be about that of the substrate alloy, and the some other elements in the maskant particles 72 are omitted or not specified, and the balance of the maskant metal is as indicated above, but preferably nickel. Optionally, the maskant particles 72 may contain chromium and/or chromium oxide. Chromium-containing or chromium-oxide-containing particles may be present in the maskant mixed with the maskant particles.

The maskant particles 72 may be of any operable size and shape. Preferably, the maskant particles 72 are generally, but not necessarily exactly, spherical. When roughly spherical, the maskant particles 72 preferably have an average diameter of from about 0.0005 to about 0.020 inch, and may be sieved to achieve a particular size distribution range.

FIGS. 4–7 illustrate four of the preferred embodiments of the maskant 62, each of which may be practiced with any of the permissible compositions of the maskant particles.

Figure 4:
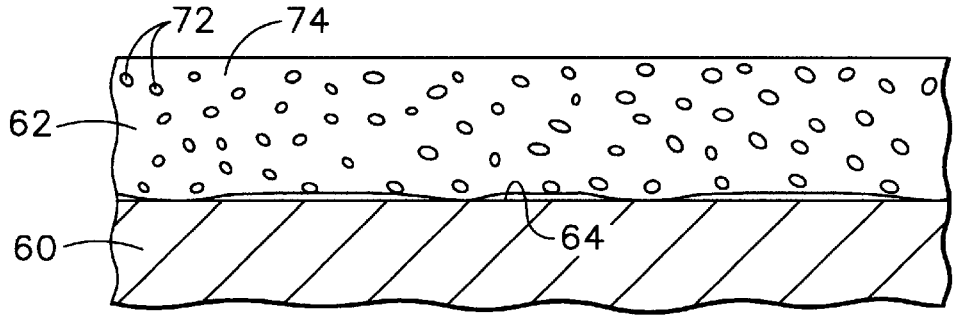
FIG. 4 is a detail of FIG. 3, illustrating a first embodiment of the maskant.

In the embodiment of FIG. 4, the maskant particles 72 are distributed generally uniformly throughout the thickness of the maskant 62. The maskant particles 72 are supported in a binder 74, which is typically a mixture of ceramic particles such as aluminum oxide, aluminum silicate, or chromium oxide. Organic binders and also binders including unreactive metal powders may also be used. The maskant particles 72 preferably constitute from about 5 to about 90 volume fraction of the maskant 62 in this embodiment.

Figure 5:
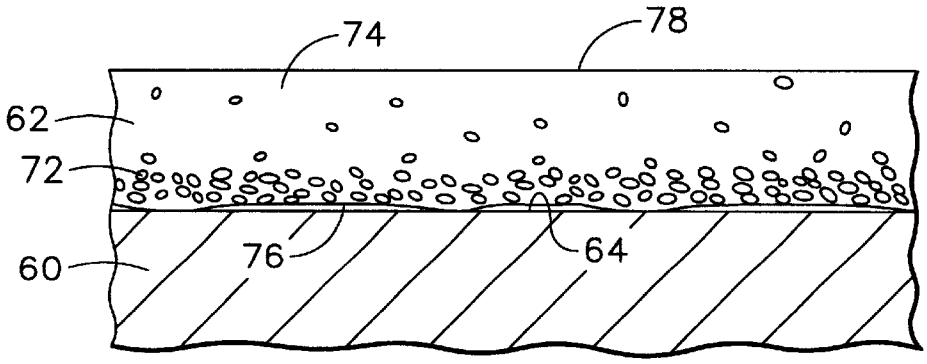
FIG. 5 is a detail of FIG. 3, illustrating a second embodiment of the maskant.

In the embodiment of FIG. 5, the maskant particles 72 are not distributed uniformly. The maskant 62 may be described as having a first surface 76 adjacent to the surface 64 of the substrate 60, and a second surface 78 remote from the surface 64. The maskant particles 72 of this embodiment are distributed nonuniformly so that most of the maskant particles 72 are located in close proximity to the first surface 76, and relatively fewer of the maskant particles 72 are located remote from the first surface 76 and close to the second surface 78 and in the central regions of the maskant 62. In this embodiment, the maskant particles 72 are embedded in the binder 74.

Figure 6:
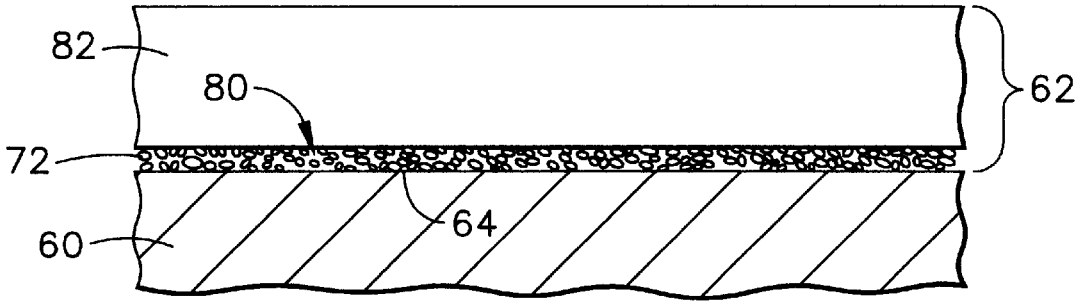
FIG. 6 is a detail of FIG. 3, illustrating a third embodiment of the maskant.

In the embodiment of FIG. 6, the maskant particles 72 lie in a particle sublayer 80 overlying and contacting the surface 64 of the substrate 60. The sublayer 80 may also comprise oxide particles and less reactive metal particles. The maskant particles 72 may be loose, they may be affixed to the substrate surface 64 with an appropriate adhesive such as a sprayable acrylic adhesive, or they may be adhered to a maskant sublayer 82. The maskant sublayer 82 overlies the particle sublayer 80 but does not contact the substrate surface 64. The maskant sublayer 82 may be a commercially purchased maskant, such as described earlier. The maskant sublayer 82 may comprise other particles such as oxide particles in a binder such as Braze-stop available from Vitta Corporation. The sublayers 80 and 82 collectively comprise the maskant 62.

Figure 7:
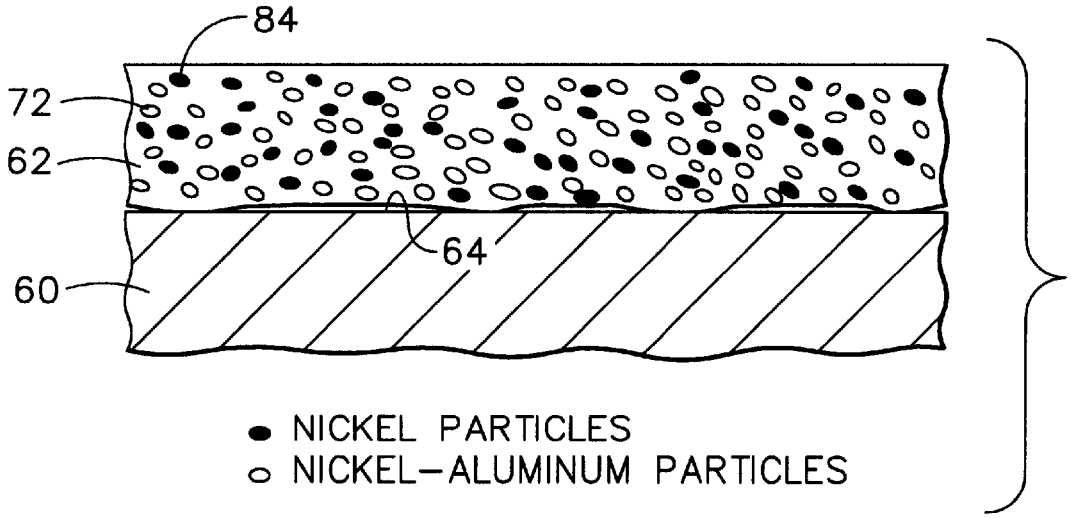
FIG. 7 is a detail of FIG. 3, illustrating a fourth embodiment of the maskant.

In the embodiment of FIG. 7, nickel particles 84 are provided in addition to the maskant particles 72. The nickel particles 84 are distinct from the maskant particles 72, because the nickel particles 84 contain substantially no aluminum (i.e., about 0.2 percent aluminum or less) and the maskant particles 72 contain larger amounts of aluminum, as discussed earlier. Any operable amount of the nickel particles 84 may be provided. The present invention is not operable, however, if only nickel particles are present with no maskant particles present. This approach of using nickel particles in addition to maskant particles is operable in the embodiments of FIGS. 4 and 5. It is also operable in the embodiment of FIG. 6, where the nickel particles are present in the maskant sublayer 82.

Returning to FIG. 2, the maskant 62 is applied to the substrate 60, numeral 44. The details of the application depend upon the form of the maskant 62. The maskants of FIGS. 4, 5, and 7 may be furnished as a tape, slurry, or putty for example, and applied directly to the surface 64 or equivalently held in direct contact with the surface 64. In FIGS. 4, 5, and 7, the maskant 62 is depicted with the first surface 76 slightly separated from the surface 64, for purposes of illustration. In practice, the maskant 62 is pressed tightly against the surface 64, and a sealant of a paste of the maskant particles 72 may be applied around the edges to prevent intrusion of aluminum into the protected region 70. In the embodiment of FIG. 6, the maskant particles 72 are first applied to the surface 64 to form the particle sublayer 80, as with an adhesive, and then the maskant sublayer 82 is applied over the particle sublayer 80. Equivalently, the maskant particles may be adhered to the surface of the maskant sublayer 82, and then the maskant sublayer 82 is applied to the surface 62 with the maskant particles 72 contacting the surface 62.

After the maskant 62 is applied, and sealed if necessary, a source of aluminum (and optionally modifying elements) is contacted to the substrate 60, numeral 46. The source of aluminum (and optional modifying elements) is preferably a gaseous source. In one approach, argon or hydrogen is passed over aluminum metal or an aluminum alloy mixed with an activator that forms the corresponding aluminum halide gas. Other elements may be doped into the gaseous source. The source gas is passed over the masked substrate, so that it contacts the exposed regions 68 but cannot contact the protected regions 70 because of the presence of the maskant 62. Aluminum is deposited onto the exposed regions 68 but not onto the protected regions 70. The deposition reaction typically occurs at elevated temperature such as from about 1800° F. to about 2100° F. so that deposited aluminum atoms interdiffuse into the substrate 60 in the exposed regions 68. The elevated deposition temperature causes interdiffusion of the deposited aluminum into the exposed regions 68 of the substrate surface 64 to form an aluminide diffusion coating. An aluminide diffusion coating about 0.002 inch thick may * be deposited in 4–16 hours using this approach. Other known and operable aluminum-deposition techniques such as pack cementation, vapor phase aluminiding, above-the-pack processing, and chemical vapor deposition may also be used.

After the aluminum coating onto the exposed regions 68 has been deposited in step 46, the masked substrate is cooled to room temperature and the maskant 62 is mechanically removed, numeral 48.

The aluminum-coated substrate is optionally heat treated, numeral 50, if even further interdiffusion is desired. The heat treatment 50 diffuses the aluminum from the coating in the exposed region 68 into the underlying substrate 60. In another embodiment, the substrate is furnished with a pre-existing coating of another material, such as platinum metal. The heat treatment 50 continues the interdiffusion of the platinum metal and aluminum started during the step 46, in the event that further interdiffusion is required. The result is a diffusion aluminide coating.

The aluminide-coated substrate is optionally post-processed, numeral 52. Post processing can include a number of types of operations. For example, a ceramic thermal barrier coating layer may be deposited over the diffused aluminide coating or diffusion aluminide of the exposed regions 68, produced as described earlier. The result is a thermal barrier coating system with the diffused aluminide coating or the diffusion aluminide acting as a bond coat. Other types of post processing involve machining of details onto the coated article, final machining, cleaning, and the like.

The present approach permits the aluminiding of the exposed regions 68, but there is little or no depletion of aluminum content from the protected regions 70 of the surface 64 of the substrate 60. By contrast, in processing using conventional maskants, there is typically an undesirable depletion of aluminum content at the surface 64, to a depth from about 0.0005 to about 0.002 inch.

The present invention has been reduced to practice using the approach of FIGS. 2 and 6. An external surface of an airfoil was masked with a commercially available braze maskant tape of inert oxide particles in an organic binder, termed Braz-Stop and available from Vitta Corp., which had been modified by dipping it into a powder of Rene' 142 alloy, which served as the maskant powder. The metal powder adhered to the tape's adhesive. The face of the tape with the maskant powder thereon was held in contact with the external surface of the airfoil. The braze maskant tape served as the maskant sublayer 82 and the Rene' 142 served as the particle sublayer 80 of FIG. 6. The airfoil was subjected to a vapor-phase aluminiding coating procedure such as that described above, at 1975° F. for 6 hours. The activator was aluminum fluoride, the carrier gas was flowing argon, and the aluminum source was CrAl chips. After the coating was applied, metallographic sections were cut from the airfoil and chemically etched to reveal the substrate surface microstructure. Observations made using a light microscope at 500×magnification showed that the portions of the substrate surface that were masked did not exhibit any substantial aluminum depletion or aluminide coating. Unmasked portions of the airfoil had an aluminide coating of about 0.0016 inch thickness.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for aluminiding a surface comprising the steps of providing a metallic substrate having a substrate surface, the metallic substrate having a substrate surface composition comprising nickel, a substrate aluminum content, and other alloying elements;

applying a maskant overlying a protected region of the substrate surface to produce a masked substrate surface having an exposed region and the protected region, the maskant comprising a plurality of maskant particles, each particle having a maskant particle composition comprising both a maskant metal selected from the group consisting of nickel, cobalt, titanium, chromium, iron, and combinations thereof; and a metallic aluminum present in a maskant aluminum content, wherein the maskant aluminum content is about the same as the substrate aluminum content, and wherein the maskant comprises a maskant particle sublayer comprising the maskant particles overlying and contacting the substrate surface, and a maskant sublayer overlying the particle sublayer, the maskant sublayer comprising metallic particles of a composition different from the maskant particles; and contacting a source of aluminum to the masked substrate surface, whereby aluminum deposits on the exposed region and does not deposit on the protected region.

2. A method for aluminiding a surface comprising the steps of providing a metallic substrate having a substrate surface, the metallic substrate having a substrate surface composition comprising nickel, a substrate aluminum content, and other alloying elements;

applying a maskant overlying a protected region of the substrate surface to produce a masked substrate surface having an exposed region and tie protected region, the maskant comprising a plurality of maskant particles, each particle having a maskant particle composition comprising both a maskant metal selected from the group consisting of nickel, cobalt, titanium, chromium, iron, and combinations thereof,and a metallic aluminum present in a maskant aluminum content, wherein the particle composition is substantially the same as the substrate surface composition, and wherein the maskant comprises a maskant particle sublayer comprising the maskant particles overlying and contacting the substrate surface, and a maskant sublayer overlying the particle sublayer, the maskant sublayer comprising metallic particles of a composition different from the maskant particles; and contacting a source of aluminum to the masked substrate surface, whereby aluminum deposits on the exposed region and does not deposit on the protected region.

3. The method of claim 2, wherein the plurality of maskant particles are distributed substantially uniformly throughout the maskant particle sublayer.

4. The method of claim 2, wherein the maskant particle sublayer has a first surface and a second surface, and wherein the plurality of maskant particles are distributed nonuniformly throughout the maskant particle sublayer such that there are more maskant particles adjacent to the first surface than to the second surface.

5. The method of claim 2, wherein the maskant particle sublayer further comprises a plurality of nickel particles, each nickel particle having a nickel composition comprising nickel and substantially no aluminum.

6. The method of claim 2 wherein the maskant particle sublayer further comprises a binder in which the maskant particles are distributed.

7. The method of claim 2, wherein the source of aluminum comprises an aluminum-containing gas.

8. The method of claim 2, wherein the substrate aluminum content is from about 5 to about 7 percent by weight, and the maskant aluminum content is substantially the same as the substrate aluminum content.

9. The method of claim 2, wherein the maskant is a solid maskant, and wherein the step of applying the maskant includes a step of sealing an edge of the maskant.

10. A method for aluminiding a surface comprising the steps of providing a metallic substrate having a substrate surface, the metallic substrate having a substrate surface composition comprising nickel, a substrate aluminum content of from about 5 to about 7 percent by weight, and other alloying elements;

applying a maskant overlying a protected region of the substrate surface to produce a masked substrate surface having an exposed region and the protected region, the maskant comprising a plurality of maskant particles, each particle having a maskant particle composition comprising both a maskant metal selected from the group consisting of nickel, cobalt, titanium, chromium, iron, and combinations thereof, and a metallic aluminum present in a maskant aluminum content, wherein the maskant aluminum content is about the same as the substrate aluminum content, and wherein the maskant comprises a maskant particle sublayer comprising the maskant particles overlying and contacting the substrate surface, and a maskant sublayer overlying the particle sublayer, the maskant sublayer comprising metallic particles of a composition different from the maskant particles, and contacting a source of aluminum to the masked substrate surface, whereby aluminum deposits on the exposed region and does not deposit on the protected region.

11. The method of claim 10, wherein the particle composition is substantially the same as the substrate surface composition.

12. The method of claim 10, wherein the maskant particle sublayer further comprises a binder in which the maskant particles are distributed.

13. The method of claim 10, wherein the maskant is a solid maskant, and wherein the step of applying the maskant includes a step of sealing an edge of the maskant.

14. The method of claim 10, wherein the maskant particles are not substantially the same composition as the substrate.

* * * * *